US007413081B2

(12) United States Patent
Rogers

(10) Patent No.: US 7,413,081 B2
(45) Date of Patent: Aug. 19, 2008

(54) STACKABLE MULTI-USE SHIPPING AND STORAGE CAPSULE AND SYSTEM

(76) Inventor: Ken Rogers, 700 Colorado, Kelso, WA (US) 98626

( * ) Notice: Subject to any disclaimer, the term of this patent is extended or adjusted under 35 U.S.C. 154(b) by 333 days.

(21) Appl. No.: 11/127,815

(22) Filed: May 11, 2005

(65) Prior Publication Data

US 2006/0254947 A1 Nov. 16, 2006

(51) Int. Cl.
*B65D 21/032* (2006.01)

(52) U.S. Cl. ..... 206/509; 206/508; 206/504

(58) Field of Classification Search ..... 206/509, 206/508; 215/382, 10; 220/304, 4.27, 675, 220/608, 601, 604, 289, 676, 781, 780, 670, 220/669, 661
See application file for complete search history.

(56) References Cited

U.S. PATENT DOCUMENTS

| | | | | | |
|---|---|---|---|---|---|
| 1,343,169 | A | * | 6/1920 | Douglass | 220/62.18 |
| 1,408,944 | A | * | 3/1922 | Howard | 220/304 |
| 1,634,089 | A | * | 6/1927 | Slate | 62/386 |
| 1,814,180 | A | * | 7/1931 | Nicholls | 206/503 |
| 2,354,425 | A | * | 7/1944 | Kuhn | 220/661 |
| 2,631,747 | A | | 3/1953 | Stolte | |
| 2,826,906 | A | | 3/1958 | Rice | |
| 2,858,959 | A | * | 11/1958 | Bixby | 220/62.15 |
| 2,979,222 | A | * | 4/1961 | Levine | 220/516 |
| 3,005,572 | A | | 10/1961 | Gustofson | |
| 3,279,640 | A | | 10/1966 | Dodson | |
| 3,283,915 | A | * | 11/1966 | Maslow | 211/126.2 |
| 3,387,749 | A | * | 6/1968 | Godshalk et al. | 222/143 |
| 3,391,824 | A | * | 7/1968 | Wiseman | 206/504 |
| 3,474,843 | A | * | 10/1969 | Maris | 206/599 |
| 3,476,286 | A | | 11/1969 | Steffens | |
| 3,587,904 | A | | 6/1971 | Harris et al. | |
| 3,661,291 | A | * | 5/1972 | Hetzer | 220/787 |
| 3,719,272 | A | * | 3/1973 | Bodine et al. | 206/701 |
| D226,936 | S | | 5/1973 | Parilla | |

(Continued)

OTHER PUBLICATIONS

Better Blocks, Int'l, Belter Blocks, picture of product, 1993.

(Continued)

*Primary Examiner*—Anthony D. Stashick
*Assistant Examiner*—Robert J Hicks
(74) *Attorney, Agent, or Firm*—Rylander & Association PC; Kurt M. Rylander; Mark E. Beatty

(57) ABSTRACT

A stackable, multi-use shipping and storage containment system includes a plurality of containers with a bottom wall, vertical enclosing sidewall, and top surface forming a water-tight enclosure, including one or more raised lid upsets equivalent indentations on its bottom surface corresponding in planar arrangement, the raised lid upsets fitting tightly within the bottom indents when containers are stacked vertically, and where the raised lid upsets and corresponding bottom indentations are arranged in planar proportional geometric patterns so that a container with a plurality of lid upsets is equal to an array of single-lid containers arranged side-by-side in corresponding planar pattern, and at least one lid upset of each container is open with a means to accept a lid forming a water-tight seal which does not interfere with the vertical stacking, and where a plurality of containers with differing numbers of lid upsets can be stacked in interlocking patterns for stability.

26 Claims, 4 Drawing Sheets

U.S. PATENT DOCUMENTS

| | | | | | |
|---|---|---|---|---|---|
| 3,774,802 | A | * | 11/1973 | O'Cheskey | 220/694 |
| 3,834,351 | A | * | 9/1974 | Schmidt | 119/266 |
| 3,955,705 | A | | 5/1976 | Dubois et al. | |
| 3,998,204 | A | * | 12/1976 | Fuchs et al. | 126/565 |
| 4,078,701 | A | * | 3/1978 | Clubb | 222/130 |
| 4,245,685 | A | * | 1/1981 | Nemitz et al. | 220/780 |
| 4,363,581 | A | * | 12/1982 | Pease | 411/520 |
| 4,632,268 | A | | 12/1986 | Melzi et al. | |
| 4,691,828 | A | | 9/1987 | Slusarczyk et al. | |
| 4,964,834 | A | | 10/1990 | Myller | |
| 5,169,019 | A | * | 12/1992 | Budenbender | 220/495.08 |
| 5,259,509 | A | | 11/1993 | Boal | |
| D354,319 | S | | 1/1995 | Wilson | |
| 5,421,135 | A | | 6/1995 | Stevens et al. | |
| 5,507,389 | A | * | 4/1996 | Syrek | 206/508 |
| D371,402 | S | | 7/1996 | Knudsen | |
| 5,651,642 | A | | 7/1997 | Kelley, Jr. et al. | |
| 5,779,051 | A | | 7/1998 | Boulin | |
| 6,065,646 | A | | 5/2000 | Schwaikert | |
| 6,086,444 | A | | 7/2000 | Glickman | |
| D479,000 | S | | 8/2003 | Van Oort | |
| D482,973 | S | * | 12/2003 | Nottingham et al. | D9/531 |
| 2004/0116037 | A1 | | 6/2004 | Garpow | |

OTHER PUBLICATIONS

Eco-Blok, LLC, Eco-Blok Product Data Sheet/Spec, 2003.

* cited by examiner

STACKABLE MULTI-USE SHIPPING AND STORAGE CAPSULE AND SYSTEM

FIELD OF THE INVENTION

The present invention relates to modular containers. More particularly, the present invention relates to a stackable, interlocking, modular container system that is useful for storage and shipping of liquid and dry goods, and construction of retaining walls, shelters, and other small structures.

BACKGROUND

Containers useful for holding liquid or dry goods are old. Containers that are designed to stack vertically for convenient storage are also known. However, when these prior art containers are stacked higher than three to four courses the stacks become unstable and are likely to fall over unless braced or contained by some external means. Likewise, if several vertical stacks are set side-by-side, the entire load becomes unstable and unwieldy to transport without some external bracing, extensive strapping, or containment. These disadvantages become especially troublesome when dealing with large quantities of liquid or dry goods that must be transported in bulk, but must be distributed at the destination in smaller individual quantities. Such situations are common in disaster relief scenarios, where large amounts of food, water, fuel, and medical supplies must be distributed to and within areas lacking functioning transportation systems. Bulk quantities of aid may be trucked or airlifted into a central distribution point, but further distribution within the stricken area may require transfer to man-portable loads in order to reach individuals.

One option then is to utilize large tanks for transporting liquids, or large holds for transporting dry goods, to a distribution point for further transfer. This option is not always desirable because separate smaller containers will be required to offload individual quantities—requiring separate transportation for the smaller containers and specialized equipment to pump or otherwise dispense the bulk goods into the individual containers for redistribution. This method also requires excessive time to transfer loads during time-critical situations.

A second option would be to transport the goods in a large number of conventional small containers. This option is not desirable because large loads of conventional containers filled with product are unstable and so require special packing techniques or special transport vehicles. Another disadvantage to this method is that used containers create a large amount of waste because they have no other function than transportation or storage. The used containers either become trash in the distribution area, or the containers must be transported back to their point of origin thereby consuming valuable transportation space, excess fuel and excess time and labor in reloading.

There may also be situations where it is desirable to utilize the advantages of large capacity liquid tanks at a distribution point, but it is impossible to transport such large tanks to the distribution point. The ability to transport liquids such as fuel or drinking water in smaller portable containers (either man-portable, or easily carried by small vehicles or carts that can travel where large tanker trucks cannot) and then reassemble these small containers into the equivalent of a large tank, with a single dispensing system, would be a great advantage.

Thus, there is a need for a container system capable of storing liquid or dry goods; which can be arranged in stable stacks that are easily palletized for transportation and easily broken down for individual transfer or distribution; and which can also be reassembled to function as a large liquid storage tank.

Sandbags and similar apparatus are also known in the art. Using sandbags for constructing temporary shelters, bunkers, or retaining walls is well known. Sandbags are often used to create temporary dikes to divert flood waters or mud; to construct temporary field fortifications above and below ground; or to construct temporary weather shelters in areas without readily accessible building materials. The main advantages of sandbags are that empty bags are easily transportable; construction methods require only some dirt and labor; and hastily built or partially completed shelters can provide significant protection from weather and/or attack.

Sandbags and similar apparatus have many disadvantages, however. Sandbags become unstable when stacked vertically, so that walls higher than a few feet tall require an extremely thick base or some external structural support such as timbers and planks. Typical materials used to construct sandbags (such as burlap and nylon fabrics) are water-permeable, rapidly becoming waterlogged and unstable, and are easily torn so that frequent repair is necessary. Such materials also tend to breakdown with prolonged exposure to sun and rain, again requiring frequent repair. A further disadvantage is that, due to their water-permeability, typical sandbags can only be filled with sand, dirt, or gravel—not water. Sandbags are thus not optimal in flooding scenarios, requiring rapid construction of stable retaining walls capable of diverting water, because filling the bags with mud will not create a stable wall, and the bags cannot be filled with water—which is distressingly abundant. Another disadvantage of sandbags is that they are not useful for other purposes, and cannot easily be reused.

More durable types of sandbags have been developed, constructed from weather-resistant and watertight synthetic materials. These new types of bags still suffer from the disadvantage that they cannot be used to create stable walls higher than a few feet tall without separate structural support. These new bags also cannot be easily emptied, cleaned, and dried for long term storage and future reuse. Nor can these new bags be used for any other purpose, such as transportation of food, drinking water, medicine, or other goods. Thus, though there are improved sandbags in the prior art these improved sandbags still exhibit many of the disadvantages of older products.

Still other means have been developed for easily constructing walls or shelters, but these also have significant disadvantages. For instance, it is known in the art to utilize reusable pre-fabricated construction blocks of various materials for small retaining walls and erosion control barriers. The disadvantages of these systems are that in order to remain stable they require either a bonding agent or staking with a long rod through the stack. A further disadvantage is that prior art pre-fabricated construction blocks are heavy—weighing thirty pounds or more each—making them difficult to transport in bulk or as man-portable loads. Another disadvantage is that prior art construction blocks do not provide ready-made attachment points for useful add-ons, such as: cosmetic facings for structures, roofing tie-downs, mounting lights or signs, armor plating, handles, and straps for easier transportation, etc. Finally, known prefabricated construction blocks are not useful for any other purpose. Because they are solid rather than hollow such blocks cannot be used for transporting or storing liquid or dry goods.

Thus, there is a need for a device that can combine the advantageous features of stackable liquid tight, reusable storage containers with the advantages of sandbags and prefabricated construction blocks, but which eliminates the major disadvantages of each. The present invention seeks to address these needs.

The following represents a list of known related patents:

| Reference: | Issued to: | Date of Issue: |
|---|---|---|
| U.S. Pat. No. 6,086,444 | Glickman | Jul. 11, 2000 |
| U.S. Pat. No. 5,651,642 | Kelley, Jr. et al. | Jul. 29, 1997 |
| U.S. Pat. No. 5,421,135 | Stevens et al. | Jun. 6, 1995 |
| U.S. Pat. No. 4,964,834 | Myller | Oct. 23, 1990 |
| U.S. Pat. No. 4,691,828 | Slusarczyk et al. | Sep. 8, 1987 |
| U.S. Pat. No. 4,632,268 | Melzi et al. | Dec. 30, 1986 |
| U.S. Pat. No. 3,955,705 | Dubois et al. | May 11, 1976 |
| U.S. Pat. No. 3,587,904 | Harris et al. | Jun. 28, 1971 |
| U.S. Pat. No. 3,476,286 | Steffens | Nov. 4, 1969 |
| U.S. Pat. No. 3,279,640 | Dodson | Oct. 18, 1966 |
| U.S. Pat. No. 2,826,906 | Rice | Mar. 18, 1958 |
| U.S. Pat. No. 2,631,747 | Stolte | Mar. 17, 1953 |
| U.S. Des. Patent 479,000 | Van Oort | Aug. 26, 2003 |
| U.S. Des. Patent 371,402 | Knudsen | Jul. 2, 1996 |
| U.S. Des. Patent 354,319 | Wilson | Jan. 10, 1995 |
| U.S. Des. Patent 226,936 | Parilla | May 15, 1973 |

The teachings of each of the above-listed citations (which does not itself incorporate essential material by reference) are herein incorporated by reference. None of the above inventions and patents, taken either singularly or in combination, is seen to describe the instant invention as claimed.

SUMMARY AND ADVANTAGES

A stackable, multi-use shipping and storage container includes a container having a bottom wall, a generally vertical enclosing sidewall, and a top surface forming a water-tight enclosure, one or more raised lid upsets on said top surface, with an equal number of receiving indentations on said bottom surface corresponding in planar arrangement to said raised lid upsets, such that any of said raised lid upsets fit tightly within the said bottom indents of any other said container when said containers are stacked vertically, an opening provided in at least one lid upset to access the interior of said container, and at least one lid attachable to a corresponding number of lid upsets having openings, wherein each said lid attached to each said lid upset having an opening forms a water-tight seal.

A stackable, multi-use shipping and storage containment system includes a plurality of containers of predetermined dimensions, each of said containers comprising a bottom wall, a generally vertical enclosing sidewall, and a top surface forming a water-tight enclosure, each of said containers including either single or multiple raised lid upsets on its top surface, with an equal number of receiving indentations on its bottom surface corresponding in planar arrangement to the said raised lid upsets, such that any of said raised lid upsets fit tightly within the said bottom indents of any other said container when said containers are stacked vertically, wherein, said raised lid upsets and corresponding bottom indentations are arranged in a planar manner in proportional geometric patterns such that any one of said containers with a plurality of lid upsets has linear dimensions equal to an array of single-lid containers arranged side-by-side to correspond to the planar pattern of said multi-lid container, wherein, at least one raised lid upset of each of said containers is open with a means to accept said lid forming a water-tight seal, said lid not interfering with the vertical stacking of the said containers, and wherein, said plurality of containers with differing numbers of said raised lid upsets can be stacked in an interlocking pattern for stability.

Thus, the present invention combines the following advantages into a single system of containers: (1) the containers are easily stackable in stable arrangements for ease of handling, transport, and stowage; (2) the container capsules with plumbing connections may be stacked and manifolded to become a large continuous tank; (3) containers may be filled with water, mud, sand, dirt, gravel, concrete or other ballast to be used in constructing shelters, retaining walls, dikes, revetments, bunkers, barriers, and other structures; (4) the capsules are reusable—they can be emptied, flushed, dried, and returned to storage even after being filled with ballast; (5) the capsules may be constructed from a variety of materials to provide compatibility with specific products, such as drinking water, hydrocarbon fuels, foodstuffs, hazardous chemicals, medical supplies, and human waste; and (6) the capsules can be used to store children's toys and then the children can stack the capsules in various formations to create forts, castles and other playful structures.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

BRIEF DESCRIPTION OF THE DRAWINGS

The accompanying drawings, which are incorporated into and constitute a part of this specification, illustrate one or more embodiments of the present invention and, together with the detailed description, serve to explain the principles and implementations of the invention.

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
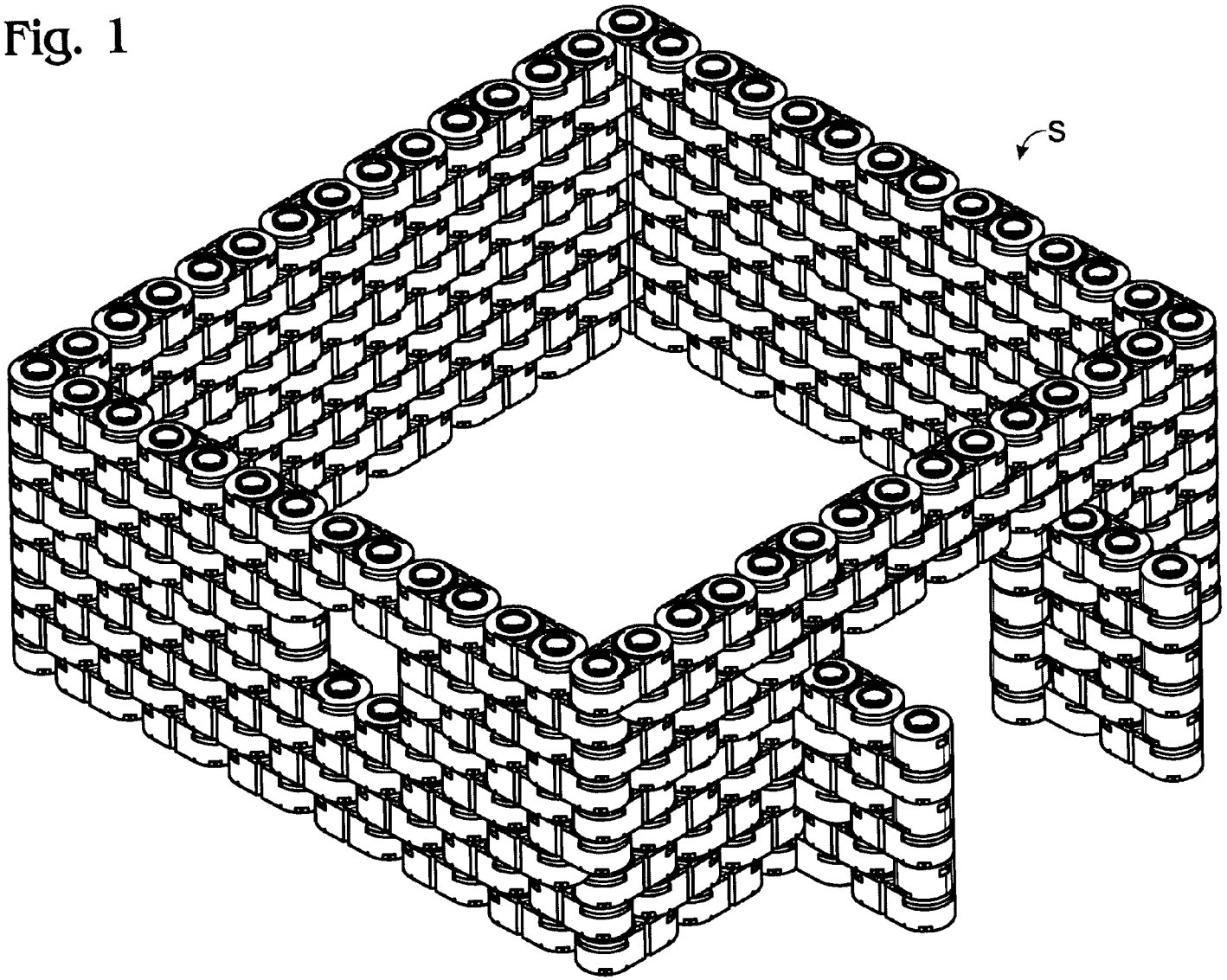
FIG. 1 shows a rectilinear structure made with and embodiment of the container and system of the present invention, with a window, an doorway, and buttresses extending from the doorway.

The stackable multi-use shipping and storage capsule and system includes a system of containers 10, 60, 70, preferably rotation-molded polyethylene, in which the lid upsets 24 in the top 12 of each container fit tightly into corresponding receiving indentations 28 in the bottom 14 of each container. As shown in FIG. 1, the lid upset 24 and receiving indentation 28 spacing is such that container rows can be stagger-stacked in parallel orientation or in a cross-linked pattern for enhanced stability, allowing the containers to be stacked to heights of nine feet or more, effectively limited only by dead load weight. The containers 10, 60, 70 are watertight, and can incorporate features to permit connection of plumbing fixtures to facilitate filling, draining, flushing, venting, or allowing multiple containers to be manifolded together to form a continuous large tank. The cross-linked stacking capabilities allow containers filled with water, dirt, sand, gravel, concrete, or other aggregate to be quickly and easily assembled into stable walls for shelters, retaining walls, revetments, etc.

The first embodiment of the container 10 has two lid upsets 24 and two corresponding indentations 28, further described as male/female interconnect features. A second embodiment of the container 70 is "T"-shaped with three of the male/female interconnect features, one at each branch. A third embodiment of the container 60 has a single male/female interconnect feature. The dimensions of the capsules are such that a standard capsule 10 is the same height, same width, but twice the length of a single capsule 60. A "T"-shaped capsule 70 has the same height as a single capsule 60, but the "T"-shaped capsule's 70 other dimensions are equivalent to placing three single capsules 60 in a "T" arrangement. Thus, the basic dimensions of any capsule with a plurality of lid upsets 24 are equal to an arrangement of an equal plurality of single capsules 60 arranged in an identical pattern. When stacking capsules this single capsule 60 may be used as a filler wherever offset rows of standard capsules 10 require an end space filler. Each type of capsule 10, 60, 70 is fitted with at least one large diameter screw on watertight lid 26, and at least one plumbing connection threaded hole 22 near the bottom of the capsule which can be plugged, fitted with a valve for dispensing, or cross-connect plumbing for manifolding.

Figure 2:
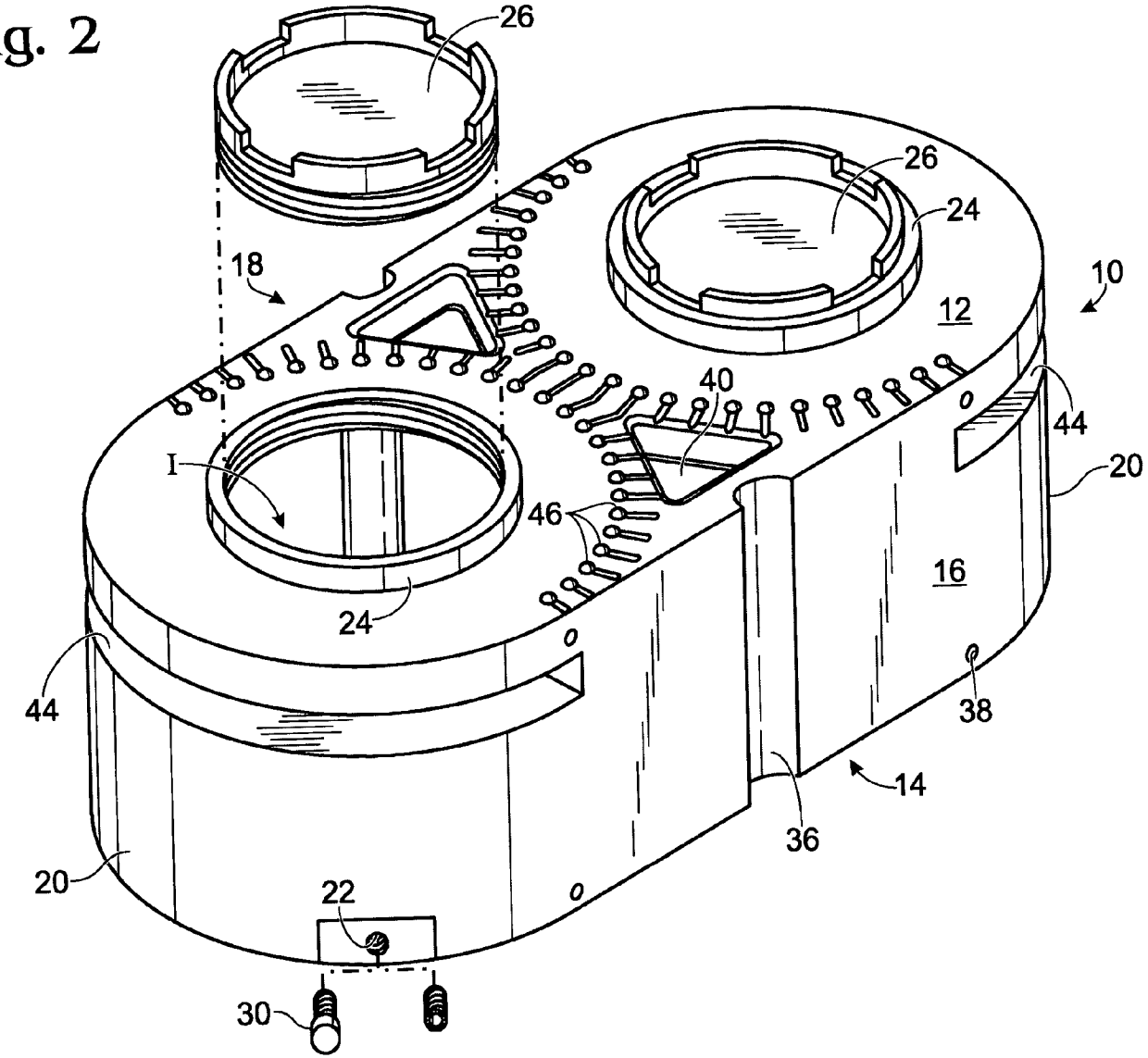
FIG. 2 shows a top isometric view of an embodiment of the present invention.
Figure 3:
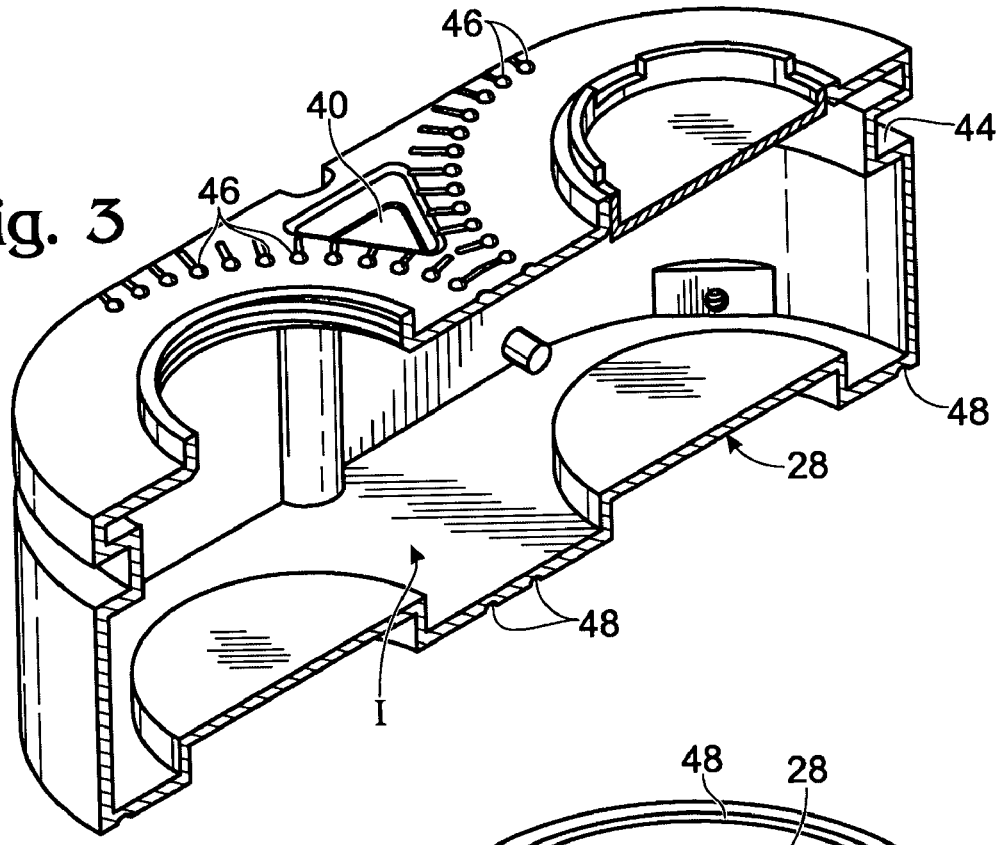
FIG. 3 shows a cutaway view of the embodiment shown in FIG. 2.
Figure 4:
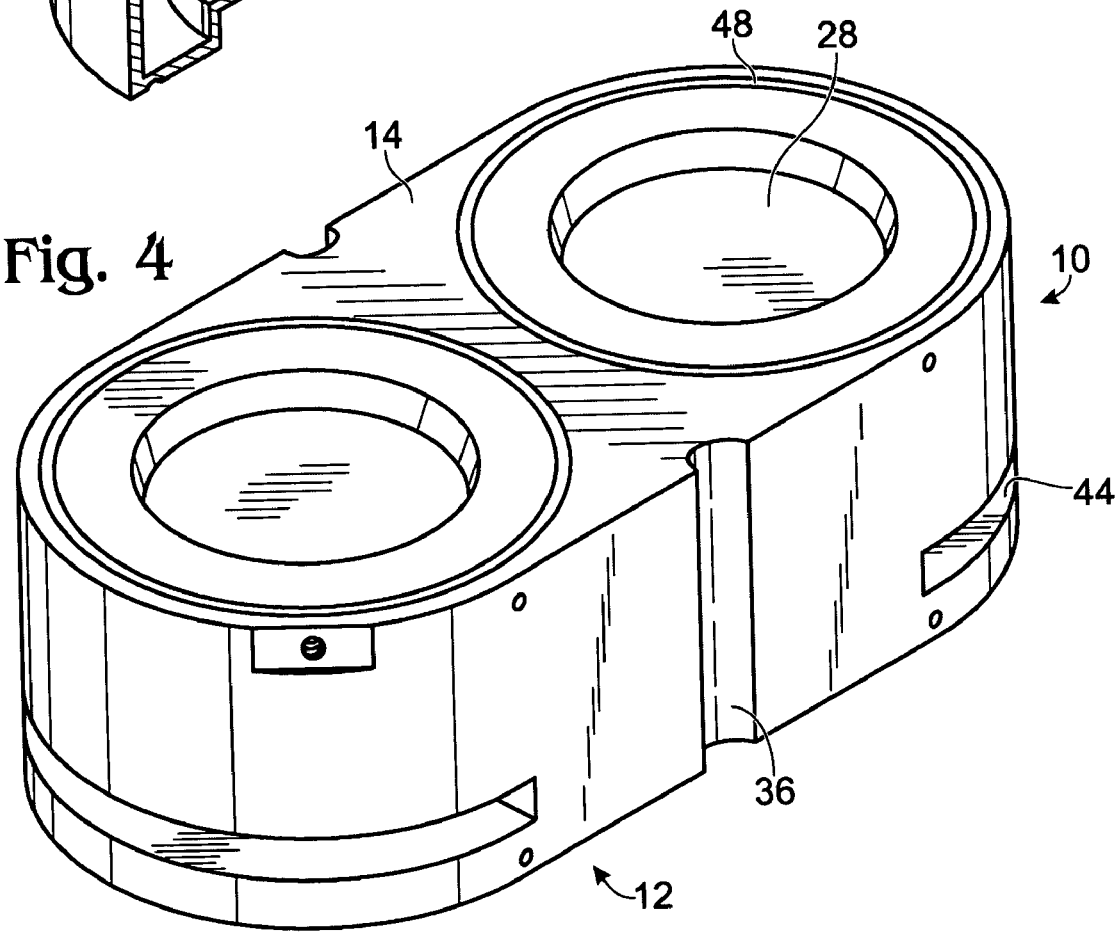
FIG. 4 shows a bottom isometric view of the embodiment shown in FIG. 2.

A first embodiment is shown in FIGS. 2-4 to be a capsule 10. The capsule 10 in this first embodiment has two lid upsets 24, each with a threaded watertight cap 26. Preferably the threaded watertight cap 26 is ten inches nominal diameter. It can be provided with an O-ring (not shown). Corresponding receiving indents 28 are provided on the bottom of each standard capsule. Receiving Indents 28 are sized to permit lid upsets 24 from any other capsule to fit tightly inside the indents. This male/female interconnect feature provides inherent stability and strength when capsules are stacked.

Threaded caps 26 insert far enough to prevent interference with the male/female interconnection, and are provided with notched crown tops to facilitate opening and closing. A threaded cap plug (not shown) can be provided in each threaded cap 26 to permit venting the capsule, or alternatively to accept a vent valve or relief valve (not shown).

The capsule is preferably constructed from rotation-molded low density polyethylene (LDPE) due to its food safe properties, compatibility with a wide range of chemicals, strength, resistance to weathering, and manufacturability. However, any suitable material can be utilized for this invention depending on the cargo, environment, manufacturing capabilities and desired cost.

A recessed threaded port 22 is located near the bottom of the capsule to provide drainage, utilizing ¾" NPT female threads to accommodate common plumbing fixtures, such as plugs 30. Multiple capsules may be cross-connected via each capsule's threaded port 22 utilizing commonly available valves, piping and/or tubing, and other fittings as necessary thereby creating a single continuous tank, or a manifold system allowing dispensing from any individual capsule.

A front sidewall 16 and rear sidewall 18 of the first embodiment are parallel in the direction of the long axis of the capsule, and generally vertical. End sidewalls 20 in the preferred embodiment are shaped with a constant radius equal to one half the distance from the flat face of front sidewall 16 to the flat face of rear sidewall 18. As seen by FIG. 3, the Interior I of the capsule is essentially hollow. In this first preferred embodiment the capsule has a volume of approximately 23 U.S. gallons. Vertical corrugations 36 are provided at the midpoint of front sidewall 16 and rear sidewall 18. Vertical corrugations 36 provide increased rigidity and strength to support compressive loads (e.g. from stacking filled capsules vertically). Vertical corrugations 36 serve a second function of allowing stiffening rods or other reinforcing means to be inserted down through cross-linked wall structures to anchor the wall to the ground or a foundation.

Four pre-tapped mounting holes 38 are inset on each of front sidewall 16 and rear sidewall 18. Mounting holes 38 provide means for mounting shelving, signage, lighting, paneling, lapping, armor plate, or other items on an assembled wall, or alternatively, could be used to mount handles for easier handling of individual capsules. An alternative would be for mount holes 38 to incorporate threaded metal inserts for increased thread strength. As seen in FIG. 3, the insets for mounting holes 38 extend into the interior volume of the capsule, to ensure sufficient thread engagement. Triangular shaped molded insets 40 provide storage for assembly hardware such as clips and bolts. Hinged covers (not shown), preferably clear, can be provided for insets 40.

Horizontal slots 44 are formed integrally into each end wall 20. Horizontal slots 44 provide ready handles individual capsules. Additionally, when capsules are assembled into linear walls horizontal slots 44 may provide ventilation or pass through points for facilities, or firing ports when capsules are used to construct bunkers.

Detents 46 are provided on the top of the capsules arranged circumferentially about each raised lid upset 24 to demark angular offsets. Circumferential grooves 48 are molded into the bottom of each capsule corresponding with radii of the detents 46 and sized to accept the detents 46. Detents 46 allow assemblers to ensure stacked capsules are oriented at the correct angle for the desired wall layout.

Figure 5:
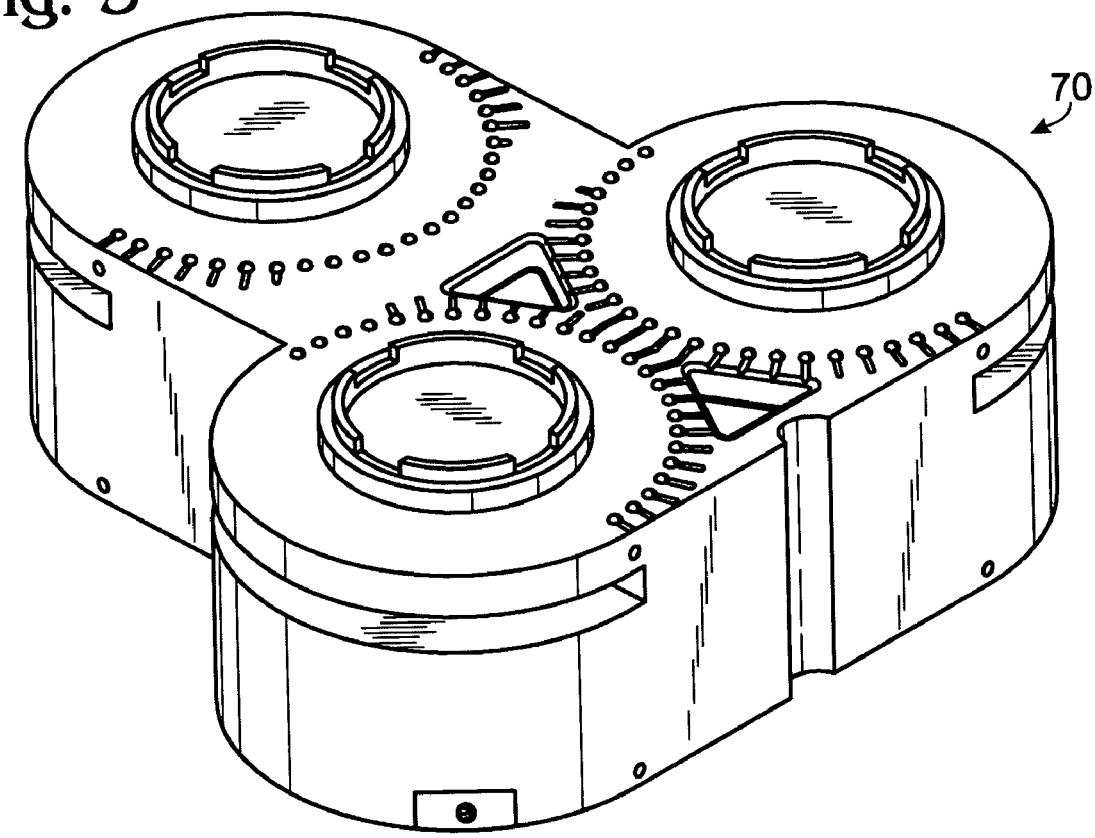
FIG. 5 shows a top isometric view of another embodiment of the present invention.

A second embodiment is shown in FIG. 5 to be a triple lid container 70. The second embodiment has similar features to the first embodiment, is designed to interoperate with the capsules described by the first and third embodiments, and comprises essentially a standard capsule as shown in FIGS. 2-4, with a third raised lid upset added. The second embodiment utilizes three raised lid upsets arranged in a "T" shape, with three corresponding receiving indents on the bottom of the capsule. The dimensions along each axis are equal, and are also equal to the length of a standard capsule shown in FIGS. 2-4.

Figure 6:
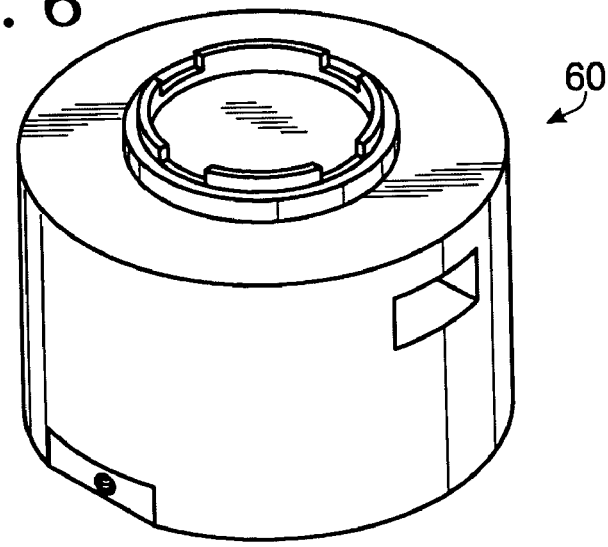
FIG. 6 shows a top isometric view of another embodiment of the present invention.

A third embodiment is shown in FIG. 6 to be a single lid container 60. The third embodiment has similar features to the first embodiment, is designed to interoperate with the capsules described by the first and second embodiments, and comprises essentially one-half of a standard module as shown in FIGS. 2-4, with a single raised lid upset on top and a corresponding receiving indent on the bottom surface of the capsule. The third embodiment is circular in shape with essentially vertical sidewalls and a radius equal to the radius of end walls in the first embodiment as shown in FIGS. 2-4. The interior is essentially hollow, providing approximately 10 U.S. gallons of capacity.

FIG. 1 demonstrates one method of using the described embodiments to construct a simple rectilinear structure S. Standard capsules 10, described by the first embodiment, are the primary building blocks. Single capsules 60, described by the third embodiment, serve as gap fillers between courses where standard modules have been removed to form a window and buttresses. "T"-shaped capsules 70, described by the second embodiment, provide tie-ins for the buttresses. Non-rectilinear structures can also be easily constructed. For added strength, the walls of such structures could be constructed by cross-linking two or more rows of capsules, or by adding more buttresses. Water-filled capsules constructed from black plastic could act as a Trombe wall, absorbing solar radiation during the day and releasing it as heat during the night. Capsules can be manufactured with foam lining the interior to provide greater insulation. Alternatively, capsules could be filled with expanding foam insulation at a construction site for even greater insulation properties. Relatively impermeable dikes could be constructed by laying plastic sheeting across the face of a buttressed wall, where the capsules can be filled rapidly with water or mud.

Protection against blast effects can be improved by filling the capsules forming the blast wall with water and leaving them uncapped, so that the capsules are not ruptured by the overpressure effect. A secondary wall constructed with capsules filled with sand, dirt, or concrete would provide added protection from shrapnel.

The container could also be used for such purposes such as a field toilet. A capsule could accept a toilet seat adaptation threaded into a raised upset, thereby providing a field toilet that can be sealed and transported to protect the environment.

The container can be used to store children's toys. In this aspect, the capsules have the added attractive feature of not only storing the toys, but being a toy themselves in that the capsules can be stacked, as shown in FIG. 1, and can create child theme structures such as forts, castles, corrals, and towers.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

I claim:

1. A stackable, multi-use shipping and storage container, comprising:

a container having a bottom wall, a generally vertical enclosing sidewall, and a top surface forming a water-tight enclosure;

one or more raised lid upsets on said top surface, with an equal number of receiving indentations on said bottom surface corresponding in planar arrangement to said raised lid upsets, such that any of said raised lid upsets fit tightly within the said bottom indents of any other said container when said containers are stacked vertically;

a hand-accessible opening provided in at least one lid upset to access the interior of said container; and at least one lid attachable to a corresponding number of lid upsets having hand-accessible openings, wherein each said lid attached to each said lid upset having a hand-accessible opening forms a water-tight seal.

2. The container of claim 1, wherein each said raised lid upset is open with means to accept a lid forming a water-tight seal, which does not interfere with the vertical stacking of the said containers.

3. The container of claim 1, wherein said container contains two or more integral indented handles, positioned symmetrically about the said containers, so as to align with the corresponding indented handles of adjacent containers providing a pass-through space when adjacent containers are arranged linearly.

4. The container of claim 1, wherein said container includes one or more penetrations through said vertical sidewall of said container, said penetration female threaded so as to accept standard plumbing fixtures with corresponding male threads; said one or more penetrations located near the bottom of said vertical sidewall so as to permit substantial drainage of said containers.

5. The container of claim 1, wherein said vertical sidewall includes one or more vertical corrugation channels.

6. The container of claim 1, further including:

one or more male indexing detents on said top surface for each raised lid upset, said indexing detents arranged concentrically with each raised lid upset and positioned at specified angular offsets; and one or more corresponding circular indent channels on said bottom wall with engaging means for at least one of the said male indexing indents, said circular indent channels arranged concentrically with each of the said receiving indents on the said bottom wall, such that said container, when stacked with other containers, may be easily aligned at angles corresponding to the said male indexing detents.

7. The container of claim 1, wherein the outside surface of the said vertical sidewall includes one or more pre-tapped mounting holes, said pre-tapped mounting holes not penetrating through the Interior face of said vertical sidewall.

8. The container of claim 7, wherein said one or more pre-tapped mounting holes contain metal threaded inserts which do not protrude past the outer surface of said vertical sidewall.

9. The container of claim 8 wherein the threaded metal inserts are constructed from stainless steel or brass material.

10. The container of claim 1, wherein said lid forming said water-tight seal in said opening includes a standard two-inch female bung thread penetration.

11. The container of claim 1, wherein said container are formed from the group of materials including low density polyethylene (LDPE), high density polyethylene (HDPE), polypropylene (PP), polyvinylchloride (PVC), and flame-retardant PVC.

12. The container of claim 1, wherein said lids are formed from the group of materials including low density polyethylene (LDPE), high density polyethylene (HDPE), polypropylene (PP), polyvinylchloride (PVC), and flame-retardant PVC.

13. The container of claim 1, wherein said container is formed from black plastic.

14. The container of claim 1, wherein said lids are formed from black plastic.

15. A stackable, multi-use shipping and storage containment system, comprising:

a plurality of containers of predetermined dimensions;

each of said containers comprising a bottom wall, a generally vertical enclosing sidewall, and a top surface forming a water-tight enclosure;

each of said containers including either single or multiple raised lid upsets on its top surface, with an equal number of receiving indentations on its bottom surface corresponding in planar arrangement to the said raised lid upsets, such that any of said raised lid upsets fit tightly within said bottom indents of any other said container when said containers are stacked vertically;

threaded lid inserts corresponding to each of said raised lid upsets for forming water tight seals therein;

wherein, said raised lid upsets and corresponding bottom indentations are arranged in a planar manner in proportional geometric patterns such that any one of said containers with a plurality of lid upsets has linear dimensions equal to an array of single-lid containers arranged side-by-side to correspond to the planar pattern of said multi-lid container;

wherein, each of said raised lid upsets of said containers includes a hand-accessible opening with a means to accept said lids forming water-tight seals, said lids not interfering with the vertical stacking of the said containers; and wherein, said plurality of containers with differing numbers of said raised lid upsets can be stacked in an interlocking pattern for stability.

16. The system of claim 15, wherein each said raised lid upset of each of said containers is open with means to accept a lid forming a water-tight seal, which does not interfere with the vertical stacking of the said containers.

17. The system of claim 15, wherein each of said containers contains two or more integral indented handles, positioned symmetrically about the said containers, so as to align with the corresponding indented handles of adjacent containers providing a pass-through space when adjacent containers are arranged linearly.

18. The system of claim 15, wherein each of said containers includes one or more penetrations through said vertical sidewall of said container, said penetration female threaded so as to accept standard plumbing fixtures with corresponding male threads; said one or more penetrations located near the bottom of said vertical sidewall so as to permit substantial drainage of said containers.

19. The system of claim 15, wherein said vertical sidewalls of said containers include one or more vertical corrugation channels.

20. The system of claim 15, further including:

one or more male indexing detente on the top surface of said containers for each raised lid upset of each of said containers, said indexing detents arranged concentrically with each raised lid upset and positioned at specified angular offsets; and one or more corresponding circular indent channels on the bottom wall of said container with engaging means for at least one of the said male indexing indents, said circular indent channels arranged concentrically with each of the said receiving indents on the said bottom wall of said container, such that said containers may be easily aligned at angles corresponding to the said male indexing detents.

21. The system of claim 15, wherein the outside surface of the said vertical sidewall of each of said containers include one or more pre-tapped mounting holes, said pre-tapped mounting holes not penetrating through the interior face of said vertical sidewall.

22. The system of claim 21, wherein said one or more pre-tapped mounting holes contain metal threaded inserts which do not protrude past the outer surface of said vertical sidewall.

23. The system of claim 22 wherein the threaded metal inserts are constructed from stainless steel or brass material.

24. The system of claim 15, wherein said lid forming said water-tight seal in said opening includes a standard two-inch female bung thread penetration.

25. The system of claim 15, wherein said containers and said lids are formed from the group of materials including low density polyethylene (LDPE), high density polyethylene (HDPE), polypropylene (PP), polyvinylchloride (PVC), and flame-retardant PVC.

26. The system of claim 15, wherein said containers are formed from black plastic.

* * * * *